US012339067B2

(12) United States Patent
Mu et al.

(10) Patent No.: US 12,339,067 B2
(45) Date of Patent: Jun. 24, 2025

(54) THIN-PLATE LOOP HEAT PIPE

(71) Applicant: ShengRongYuan(Suzhou) Technology Co., Ltd, Suzhou (CN)

(72) Inventors: Yongbin Mu, Suzhou (CN); Xiuhong Zhao, Suzhou (CN)

(73) Assignee: ShengRongYuan(Suzhou) Technology Co., Ltd, Suzhou (CN)

( * ) Notice: Subject to any disclaimer, the term of this patent is extended or adjusted under 35 U.S.C. 154(b) by 56 days.

(21) Appl. No.: 18/279,870

(22) PCT Filed: Nov. 26, 2021

(86) PCT No.: PCT/CN2021/133542
§ 371 (c)(1),
(2) Date: Aug. 31, 2023

(87) PCT Pub. No.: WO2022/183793
PCT Pub. Date: Sep. 9, 2022

(65) Prior Publication Data

US 2024/0044582 A1 Feb. 8, 2024

(30) Foreign Application Priority Data

Mar. 1, 2021 (CN) ..... 202110222991.8
Mar. 1, 2021 (CN) ..... 202120431012.5

(51) Int. Cl.
*F28D 15/00* (2006.01)
*F28D 15/02* (2006.01)
(Continued)

(52) U.S. Cl.
CPC ..... *F28D 15/0266* (2013.01); *F28D 15/043* (2013.01); *F28D 2021/0029* (2013.01)

(58) Field of Classification Search
CPC .. F28D 15/0266; F28D 15/043; F28D 15/046; F28D 2021/0029
See application file for complete search history.

(56) References Cited

U.S. PATENT DOCUMENTS 6,058,711 A * 5/2000 Maciaszek ..... F28D 15/043 62/515
6,330,907 B1 * 12/2001 Ogushi ..... F28D 15/043 165/907

(Continued)

FOREIGN PATENT DOCUMENTS

CN 104930893 A 9/2015
CN 205262267 U 5/2016

(Continued)

*Primary Examiner* — Travis Ruby
(74) *Attorney, Agent, or Firm* — IPRTOP LLC

(57) ABSTRACT

A thin-plate loop heat pipe comprises a housing including a first housing plate and a second housing plate that are relatively covered and sealed together at edges. An evaporation chamber, a vapor channel, a condensation chamber, a liquid channel, a compensation chamber and an auxiliary fluid channel are formed between the first housing plate and the second housing plate. The compensation chamber stores a liquid-phase working medium. A first capillary structure divides the evaporation chamber into a first vapor chamber and a second vapor chamber. The second vapor chamber is located between the first vapor chamber and the compensation chamber, the second vapor chamber is separated from the compensation chamber by the first capillary structure, the first vapor chamber and the condensation chamber communicate with each other by the vapor channel, the second vapor chamber and the condensation chamber communicate with each other by the auxiliary fluid channel.

19 Claims, 5 Drawing Sheets

(51) Int. Cl.
*F28D 15/04* (2006.01)
*F28D 21/00* (2006.01)

(56) References Cited

U.S. PATENT DOCUMENTS

| | | | | |
|---|---|---|---|---|
| 2008/0283223 | A1 | 11/2008 | Chang et al. | |
| 2015/0338171 | A1 | 11/2015 | Torres Sepúlveda et al. | |
| 2019/0331432 | A1* | 10/2019 | Tseng | B33Y 10/00 |
| 2019/0335619 | A1* | 10/2019 | Tseng | H01L 23/427 |

FOREIGN PATENT DOCUMENTS

| | | | |
|---|---|---|---|
| CN | 108253830 | A | 7/2018 |
| CN | 110530185 | A | 12/2019 |
| CN | 112201635 | A | 1/2021 |
| CN | 215572347 | U | 1/2022 |
| FR | 2755219 | A3 | 4/1998 |

* cited by examiner

THIN-PLATE LOOP HEAT PIPE

FIELD OF TECHNOLOGY

The present disclosure relates to the technical field of heat dissipation devices, in particular, to a thin-plate loop heat pipe.

BACKGROUND

In recent years, many electronic devices have been developed towards being ultra-thin and compact, while generating more heat. Conventional heat pipes are no longer able to meet the requirements of electronic devices in heat dissipation.

The technology of loop heat pipes is an advanced phase change heat transfer technology. A loop heat pipe includes five basic components: an evaporator (with capillary wick), a vapor line, a condenser, a liquid line, and a compensator. These five components are connected in turn to form a closed loop with working medium circulating inside. The working principle of the loop heat pipe is as follows: the evaporator contacts with a heat source, the liquid-phase working medium vaporizes on the surface of the capillary wick inside the evaporator, the vaporized working medium enters the condenser along the vapor line and exothermically condenses into liquid-phase working medium in the condenser. The liquid-phase working medium then flows to the compensator along the liquid line and soaks the capillary wick inside the evaporator, and the liquid-phase working medium is heated and evaporated again to enter the next cycle. Compared with conventional heat pipes, the loop heat pipe has a greater heat transfer capacity, longer heat transfer distance, and more flexible layout.

However, the existing loop heat pipes have a large thickness, and their main components are usually separated and connected by welding, which makes the process complex. In addition, as the pressure and temperature of the evaporator are higher than that of the compensator during the normal operation of the loop heat pipe, heat load may be leaked from the evaporator to the compensator, known as heat leakage. According to the working principle of the loop heat pipe, the heat leakage needs to be offset by increasing the subcooling degree of the liquid-phase working medium refluxed from the condenser to maintain the heat balance of the compensator. The greater the heat leakage, the greater the required subcooling degree of the liquid-phase working medium refluxed from the condenser, resulting in a large heat transfer temperature difference between cold and hot ends of the loop heat pipe, which affects the heat transfer performance of the loop heat pipe. When the loop heat pipe is miniaturized, the problem of heat leakage from the evaporator to the compensator becomes more prominent, resulting in a significant decrease in the heat transfer efficiency of the loop heat pipe. Therefore, the existing loop heat pipes cannot meet the heat dissipation requirements of high heat flux electronic devices with an ultra-thin and compact structure.

SUMMARY

The present disclosure provides a thin-plate loop heat pipe, with simple, efficient manufacturing processes and low heat transfer temperature difference.

The thin-plate loop heat pipe includes a housing. The housing includes a first housing plate and a second housing plate that are relatively covered and sealed together at edges.

An evaporation chamber, a vapor channel, a condensation chamber, a liquid channel, a compensation chamber and an auxiliary fluid channel are formed between the first housing plate and the second housing plate. The compensation chamber stores a liquid-phase working medium. A first capillary structure is provided in the evaporation chamber to divide the evaporation chamber into a first vapor chamber and a second vapor chamber. The second vapor chamber is located between the first vapor chamber and the compensation chamber, the second vapor chamber is separated from the compensation chamber by the first capillary structure, the first vapor chamber and the condensation chamber communicate with each other by the vapor channel, the condensation chamber and the compensation chamber communicate with each other by the liquid channel, and the second vapor chamber and the liquid channel communicate with each other by the auxiliary fluid channel.

Preferably, a flow channel is provided in the condensation chamber.

Preferably, two ends of the auxiliary fluid channel are respectively connected with the second vapor chamber and the liquid channel.

Preferably, two ends of the auxiliary fluid channel are respectively connected with the second vapor chamber and the condensation chamber.

Preferably, a recessed area is etched on an inner wall of the first housing plate and/or the second housing plate, the evaporation chamber, the vapor channel, the condensation chamber, the liquid channel, the compensation chamber and the auxiliary fluid channel are formed at the recessed area between the first housing plate and the second housing plate.

Preferably, the housing has a loop shape. The evaporation chamber, the vapor channel, the condensation chamber, the liquid channel and the compensation chamber are arranged in sequence along a circumference of the housing to form a closed loop.

Preferably, the auxiliary fluid channel is located at one side of the vapor channel and shares sealing edges of the housing with the vapor channel, or the auxiliary fluid channel is located at one side of the liquid channel and shares sealing edges of the housing with the liquid channel.

Preferably, the auxiliary fluid channel has sealing edges that are independent from the vapor channel and the liquid channel.

Preferably, the first capillary structure and the housing are separate structures, and the first capillary structure includes one or more of wire mesh, powder sintered material, metal felt, fiber bundle, foam metal and laminated perforated metal sheets.

Preferably, a concave structure is provided on one end of the first capillary structure closing to compensation chamber to form the second vapor chamber between the concave structure and the housing.

Preferably, the first capillary structure and the housing form a one-piece structure, a plurality of first microchannels are etched on an inner wall of the first housing plate at the evaporation chamber, a plurality of second microchannels are etched on the inner wall of the second housing plate at the evaporation chamber, and the first microchannel and the second microchannel are arranged in a cross pattern to form the first capillary structure.

Preferably, a groove is also etched on the inner wall of the second housing plate corresponding to evaporation chamber, the groove and the second microchannel are separated and independent from each other, one end of the first microchannel intersects with the second microchannel, the other end of the first microchannel extends to intersect with the groove, and the groove, the second housing plate, the first microchannel and the first housing plate together form the second vapor chamber.

Preferably, a second capillary structure is provided in the condensation chamber. The second capillary structure extends to the evaporation chamber after passing through one or more of the vapor channel, the liquid channel and the auxiliary fluid channel, and contacts or connects with the first capillary structure.

Preferably, the second capillary structure is a third microchannel etched on an inner wall of the first housing plate and/or the second housing plate, or the second capillary structure includes one or more of wire mesh, powder sintered material, metal felt, fiber bundle, foam metal and laminated perforated metal sheets.

Preferably, a third capillary structure is provided in one or more of the condensation chamber, the vapor channel, the liquid channel and the auxiliary fluid channel.

Preferably, the third capillary structure is a fourth microchannel etched on an inner wall of the first housing plate and/or the second housing plate, or the third capillary structure includes one or more of wire mesh, powder sintered material, metal felt, fiber bundle, foam metal and laminated perforated metal sheets.

Preferably, the housing is bent in a curved shape at any one or more positions except the evaporation chamber.

Compared with the prior art, the present disclosure has significant progress:

On the one hand, the thin-plate loop heat pipe according to the present disclosure adopts a structure in which two housing plates are relatively covered and sealed together at edges, and an evaporation chamber, a vapor channel, a condensation chamber, a liquid channel, a compensation chamber and an auxiliary fluid channel are formed between these two housing plates. This integration of various components of the loop heat pipe between the two housing plates significantly simplifies the structure, reducing the entire thickness of the loop heat pipe. At the same time, the manufacturing process thereof becomes more simple and efficient. On the other hand, compared with existing loop heat pipes, the thin-plate loop heat pipe according to the present disclosure further includes a second vapor chamber and an auxiliary fluid channel, such that the heat leakage from the evaporation chamber to the compensation chamber is isolated by the second vapor chamber. Specifically, part of the liquid-phase working medium is vaporized in the second vapor chamber due to the heat leakage, the vaporized working medium in the second vapor chamber passes through the auxiliary fluid channel and flows to the liquid channel, and finally flows back to the compensation chamber to complete a cycle. The vaporization of the working medium in the second vapor chamber absorbs most of heat leakages from the evaporation chamber to the compensation chamber, which can significantly reduce the heat leaked to the compensation chamber, thereby effectively reducing the heat transfer temperature difference of the thin-plate loop heat pipe, and ensuring the heat transfer performance of the loop heat pipe. Therefore, the thin-plate loop heat pipe according to the present disclosure can greatly meet the heat dissipation requirements of high heat flux electronic devices with an ultra-thin and compact structure.

REFERENCE NUMBERS

Figure 1:
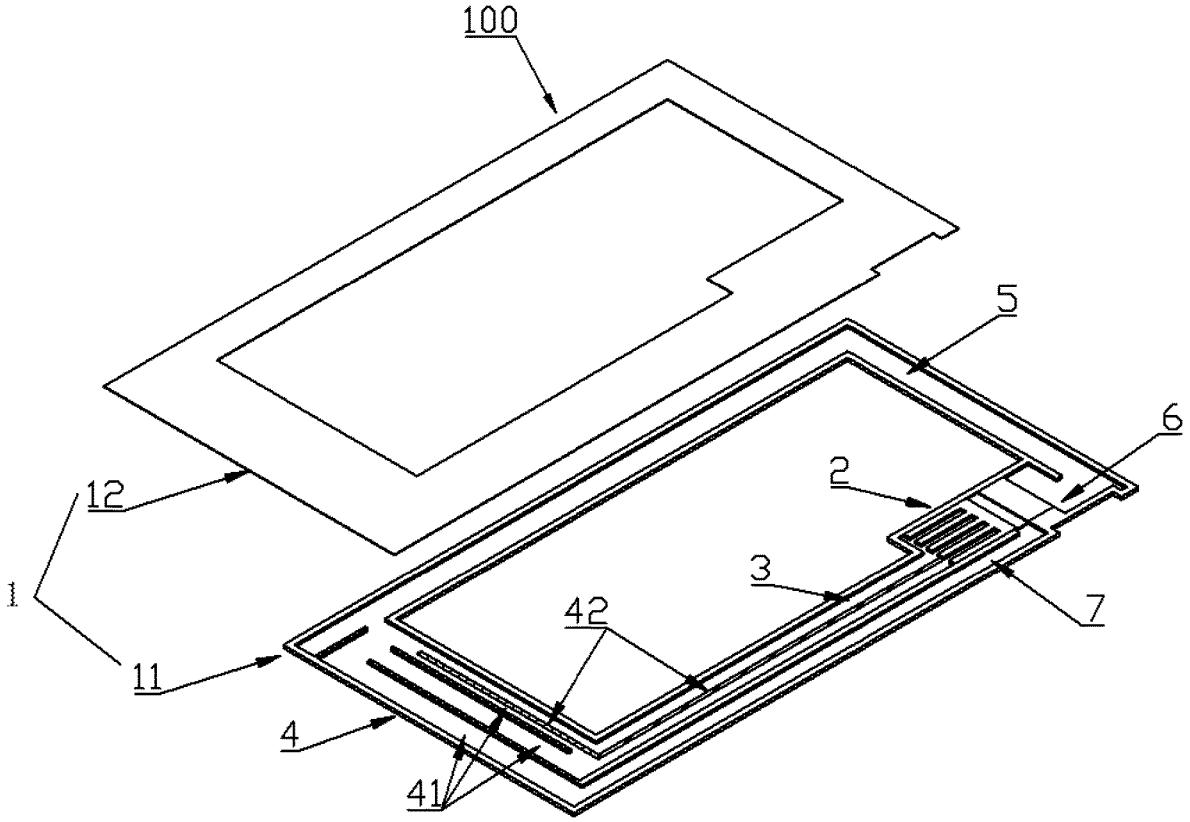
FIG. 1 is a schematic view of a thin-plate loop heat pipe having a separable structure according to the first embodiment of the present disclosure.

100 Thin-plate loop heat pipe
1 Housing
11 First housing plate
11*a* First microchannel
12 Second housing plate
12*a* Second microchannel
12*b* Groove
12*c* Slot
2 Evaporation chamber
21 First capillary structure
22 First vapor chamber
23 Second vapor chamber
3 Vapor channel
4 Condensation chamber
41 Flow channel
42 Second capillary structure
5 Liquid channel
6 Compensation chamber
7 Auxiliary fluid channel
8 Third capillary structure
200 Electronic device
201 Shell
202, 203, 204 Heat source

DETAILED DESCRIPTION

The specific embodiments of the present disclosure will be further described below in conjunction with the accompanying drawings. These embodiments are only intended to illustrate the scheme of the present disclosure, and should not be understood as limitative.

In the description of the present disclosure, it should be noted that, orientation or positional relationships indicated by terms "center", "longitudinal", "transverse", "upper", "lower", "front", "rear", "left", "right", "vertical", "horizontal", "top", "bottom", "inner", "outer", etc. are based on the orientation or positional relationships shown in the accompanying drawings, and are only for the convenience of describing the present disclosure as well as simplifying specifications, do not indicate or imply that the relevant devices or elements must have a particular orientation and be configured or operated in the particular orientation. Therefore, it should not be construed as limitative. In addition, the terms like "first" and "second" are used for indication purpose only, and are not to be construed as indicating or implying relative importance.

In the description of the present disclosure, it should be noted that, unless otherwise specified and limited, terms "installation", "attachment" and "connection" should be understood in a broad sense, for example, it can be a fixed connection, a detachable connection or an integrated connection; it can be mechanically connected or electrically connected; it can be directly connected or indirectly connected through an intermedium, and it can also be an internal communication between two components. Those of ordinary skill in the art can understand the specific meanings of the above terms in the present disclosure, according to specific situations.

In addition, in the description of the present disclosure, unless otherwise specified, "a plurality of" means two or more.

As shown in FIGS. 1 to 9, one embodiment of the thin-plate loop heat pipe according to the present disclosure is illustrated.

Figure 2:
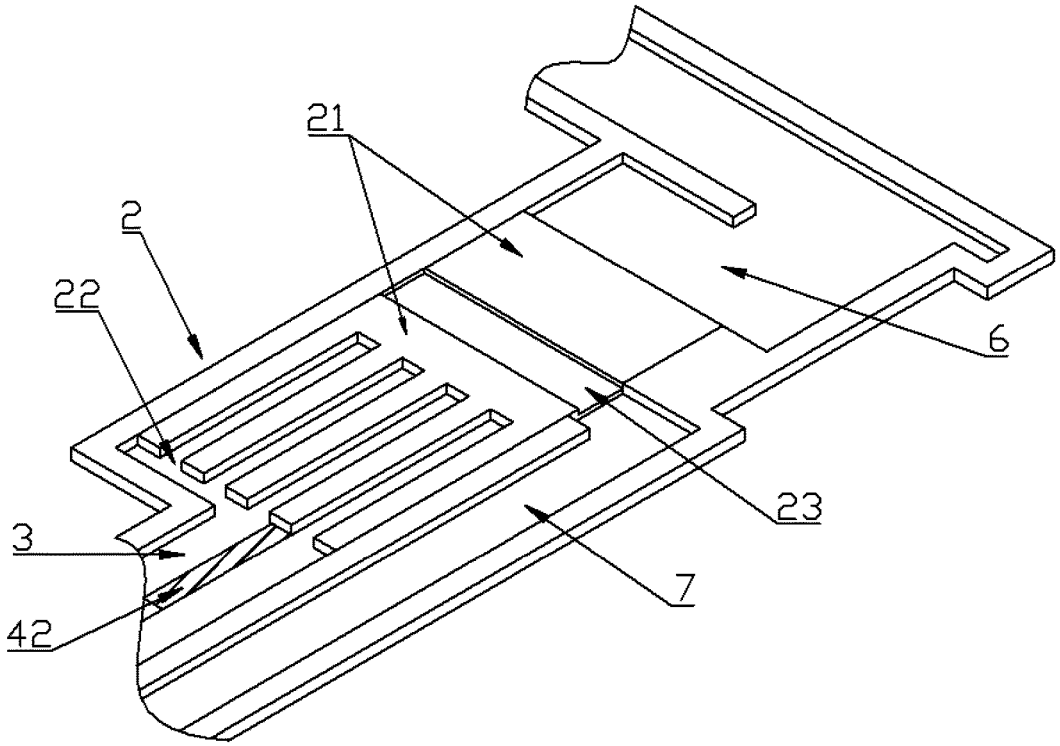
FIG. 2 is a partially enlarged schematic view of FIG. 1.
Figure 9:
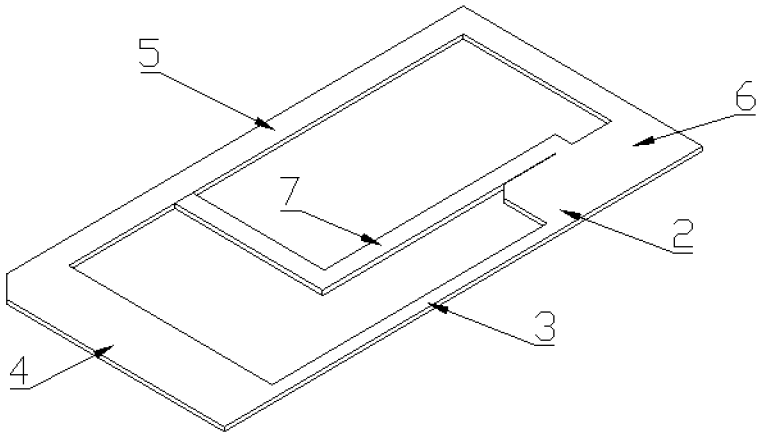
FIG. 9 is a schematic view of a thin-plate loop heat pipe according to the sixth embodiment of the present disclosure.

Refer to FIGS. 1, 2, and 9, a thin-plate loop heat pipe 100 of the embodiment includes a housing 1. The housing 1 includes a first housing plate 11 and a second housing plate 12 that are relatively covered. The first housing plate 11 and the second housing plate 12 are sealed together at edges to form sealing edges of the housing 1, thereby forming a sealed space within the housing 1, between the first housing plate 11 and the second housing plate 12. An evaporation chamber 2, a vapor channel 3, a condensation chamber 4, a liquid channel 5, a compensation chamber 6, and an auxiliary fluid channel 7 are formed between the first housing plate 11 and the second housing plate 12. A first capillary structure 21 is provided in the evaporation chamber 2 and divides the evaporation chamber 2 into a first vapor chamber 22 and a second vapor chamber 23. The second vapor chamber 23 is located between the first vapor chamber 22 and the compensation chamber 6, the second vapor chamber 23 is separated from the compensation chamber 6 by the first capillary structure 21, and by the first capillary structure 21, the second vapor chamber 23 is also separated from the first vapor chamber 22. The first capillary structure 21 can allow the liquid-phase working medium to permeate and prevent the vaporized working medium from circulating between the second vapor chamber 23 and the compensation chamber 6, and between the second vapor chamber 23 and the first vapor chamber 22. The first vapor chamber 22 and the condensation chamber 4 communicate with each other by the vapor channel 3, the condensation chamber 4 and the compensation chamber 6 communicate with each other by the liquid channel 5, and the auxiliary fluid channel 7 connects the second vapor chamber 23 with the liquid channel 5, that is, the second vapor chamber 23 and the liquid channel 5 communicate with each other by the auxiliary fluid channel 7. The liquid-phase working medium stored in the compensation chamber 6 can permeate and soak the first capillary structure 21 in the evaporation chamber 2.

Figure 3:
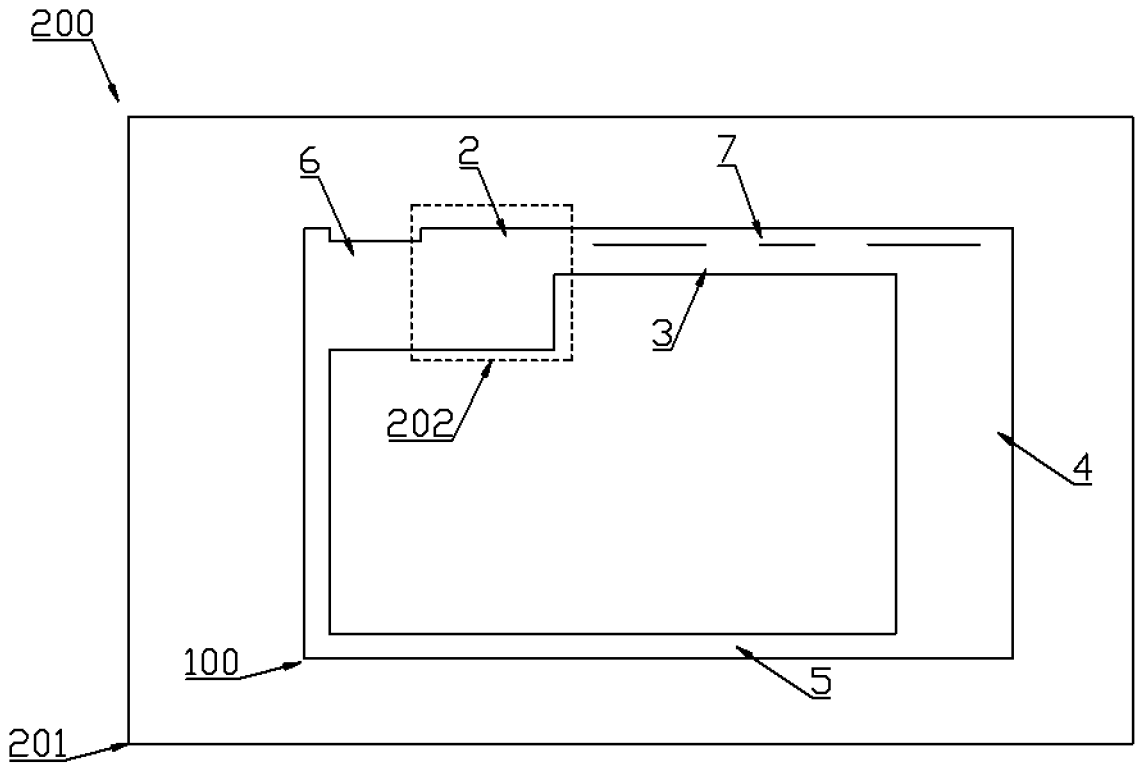
FIG. 3 is a schematic view of the usage of the thin-plate loop heat pipe according to the first embodiment of the present disclosure.

Refer to FIG. 3, the thin-plate loop heat pipe 100 of the embodiment can be accommodated in a shell 201 of an electronic device 200 when in use. The shell 201 of the electronic device 200 has a heat source 202, the evaporation chamber 2 of the thin-plate loop heat pipe 100 is in contact with the heat source 202. The working principle of the thin-plate loop heat pipe 100 is as follows: the evaporation chamber 2 is in contact with the heat source 202 to absorb the heat from the heat source 202, the liquid-phase working medium in the first vapor chamber 22 is vaporized on the surface of the first capillary structure 21, the vaporized working medium passes through the vapor line 3 and enters the condensation chamber 4, and releases heat and condenses in the condensation chamber 4, then the condensed liquid-phase working medium passes through the liquid channel 5 and flows back to the compensation chamber 6 and the evaporation chamber 2, thus completing one cycle. At the same time, as the temperature and pressure in the evaporation chamber 2 are higher than that of the working medium in the compensation chamber 6, the evaporation chamber 2 begins to transfer heat to the compensation chamber 6. When the heat is transferred to the second vapor chamber 23, the liquid-phase working medium in the second vapor chamber 23 is heated and vaporized, this process absorbs most of the heat transferred from the evaporation chamber 2 to the compensation chamber 6, thus significantly reducing the heat leaked to the compensation chamber 6. The working medium vaporized in the second vapor chamber 23 passes through the auxiliary fluid channel 7 and flows to the liquid channel 5, then flows back to the compensation chamber 6 and the evaporation chamber 2, thereby completing another cycle. These two cycles are performed side by side at the same time.

On the one hand, the thin-plate loop heat pipe 100 of this embodiment adopts a structure in which two housing plates are relatively covered and sealed together at edges, and an evaporation chamber 2, a vapor channel 3, a condensation chamber 4, a liquid channel 5, a compensation chamber 6 and an auxiliary fluid channel 7 are formed between these two housing plates. This integration of various components of the thin-plate loop heat pipe between the two housing plates significantly simplifies the structure, reducing the entire thickness of the thin-plate loop heat pipe 100. At the same time, the manufacturing process thereof becomes simple and more efficient. On the other hand, compared with existing loop heat pipes, the thin-plate loop heat pipe 100 of this embodiment further includes a second vapor chamber 23 and an auxiliary fluid channel 7, such that the heat leakage from the evaporation chamber 2 to the compensation chamber 6 is thermally isolated by the second vapor chamber 23. Specifically, part of the liquid-phase working medium is vaporized in the second vapor chamber 23 due to the heat leakage, the vaporized working medium in the second vapor chamber 23 passes through the auxiliary fluid channel 7 and flows to the liquid channel 5, and finally flows back to the compensation chamber 6 to complete a cycle. The vaporization of the working medium in the second vapor chamber 23 absorbs most of heat leakages from the evaporation chamber 2 to the compensation chamber 6, which can significantly reduce the heat leaked to the compensation chamber 6, thereby effectively reducing the heat transfer temperature difference of the thin-plate loop heat pipe 100, and ensuring the heat transfer performance of the loop heat pipe 100. Therefore, the thin-plate loop heat pipe 100 of this embodiment can greatly meet the heat dissipation requirements of high heat flux electronic devices with an ultra-thin and compact structure.

In the present embodiment, the manner in which the auxiliary fluid channel 7 connects the second vapor chamber 23 with the liquid channel 5 is not limited.

Refer to FIGS. 1, 4, 6 and 8, in one embodiment, two ends of the auxiliary fluid channel 7 are respectively connected with the second vapor chamber 23 and the condensation chamber 4, and the condensation chamber 4 is connected with the liquid channel 5, thus realizing the connection between the second vapor chamber 23 and the liquid channel 5, via the auxiliary fluid channel 7. The working medium vaporized in the second vapor chamber 23 enters the condensation chamber 4 through the auxiliary fluid channel 7, and releases heat and condenses in the condensation chamber 4, then the condensed liquid-phase working medium in the condensation chamber 4 flows back to the compensation chamber 6 along the liquid channel 5, together with the condensed working medium flowing through the vapor channel 3.

Referring to FIG. 9, in another embodiment, two ends of the auxiliary fluid channel 7 are respectively connected with the second vapor chamber 23 and the liquid channel 5, that is, the auxiliary fluid channel 7 is directly connected with the liquid channel 5. The working medium vaporized in the second vapor chamber 23 enters the liquid channel 5 directly through the auxiliary fluid channel 7. As this section has less vaporized working medium, the working medium gradually releases heat and condenses in its flowing process through the auxiliary fluid channel 7 and the liquid channel 5, and finally returns to the compensation chamber 6.

In the present embodiment, preferably, a recessed area is etched on the inner wall of the first housing plate 11 and/or the second housing plate 12, and the evaporation chamber 2, the vapor channel 3, the condensation chamber 4, the liquid channel 5, the compensation chamber 6 and the auxiliary fluid channel 7 are formed at the recessed area between the first housing plate 11 and the second housing plate 12. Specifically, the recessed area may be etched on the inner wall of one of the first housing plate 11 and the second housing plate 12, and the inner wall of the other has a flat surface. The recessed area on one housing plate and the flat surface on the other housing plate relatively cover each other to form the sealed space within the housing 1, and the evaporation chamber 2, the vapor channel 3, the condensation chamber 4, the liquid channel 5, the compensation chamber 6, and the auxiliary fluid channel 7 are formed within the sealed space. Alternatively, recessed areas may be etched on the inner walls of both the first housing plate 11 and the second housing plate 12. The recessed areas on two housing plates relatively cover each other to form the sealed space within the housing 1, and the evaporation chamber 2, the vapor channel 3, the condensation chamber 4, the liquid channel 5, the compensation chamber 6, and the auxiliary fluid channel 7 are formed within the sealed space. Herein, the inner walls of the first housing plate 11 and the second housing plate 12 refer to the opposite wall surfaces of the first housing plate 11 and the second housing plate 12.

Refer to FIG. 1, in the present embodiment, preferably, a flow channel 41 is provided in the condensation chamber 4. The working medium vaporized in the evaporation chamber 2 passes through the vapor channel 3 and the auxiliary fluid channel 7 and enters the condensation chamber 4, then flows along the flow channel 41 in the condensation chamber 4 and releases heat to the outside and condenses. The condensation chamber 4 can be provided with multiple flow channels 41 arranged side by side. The flow channel 41 can be formed by etching the inner wall of the first housing plate 11 and/or the second housing plate 12 at the position where the condensation chamber 4 is located. Specifically, the flow channel 41 can be etched on the inner wall of one of the first housing plate 11 and the second housing plate 12, or on the inner walls of both the first housing plate 11 and the second housing plate 12.

Refer to FIG. 1, in this embodiment, preferably, the housing 1 has a loop shape, and the evaporation chamber 2, the vapor channel 3, the condensation chamber 4, the liquid channel 5 and the compensation chamber 6 are arranged in sequence along the circumference of the housing 1 to form a closed loop. The sealing edges of the housing 1 include an outer peripheral sealing edge and an inner peripheral sealing edge, and the evaporation chamber 2, the vapor channel 3, the condensation chamber 4, the liquid channel 5, and the compensation chamber 6 are all formed between the outer peripheral sealing edge and the inner peripheral sealing edge of the housing 1.

The arrangement of the auxiliary fluid channel 7 is not limited. For example, referring to FIGS. 1, 6 and 8, the auxiliary fluid channel 7 can be located at one side of the vapor channel 3 and share the sealing edges of the housing 1 with the vapor channel 3, that is, the auxiliary fluid channel 7 can be arranged in parallel with the vapor channel 3 and be formed between the outer peripheral sealing edge and the inner peripheral sealing edge of the housing 1. Alternatively, the auxiliary fluid channel 7 can be located at one side of the liquid channel 5 and share the sealing edges of the housing 1 with the liquid channel 5, that is, the auxiliary fluid channel 7 can be arranged in parallel with the liquid channel 5 and be formed between the outer peripheral sealing edge and the inner peripheral sealing edge of the housing 1. Alternatively, referring to FIGS. 4 and 9, the auxiliary fluid channel 7 can have sealing edges that are independent from the vapor channel 3 and the liquid channel 5, and interval spaces can be formed between the auxiliary fluid channel 7 and the vapor channel 3 as well as between the auxiliary fluid channel 7 and the liquid channel 5. In practice, the arrangement of the auxiliary fluid channel 7 can be selected and determined according to conditions such as the usage situation and installation position of the electronic device 200, so as to better adapt to different electronic devices 200 and usage environments.

In the present embodiment, the shape and structure forms of the first capillary structure 21 are not limited.

Refer to FIG. 2, in one embodiment, the first capillary structure 21 and the housing 1 can be separate structures, the first capillary structure 21 can be combined with the inner wall of the first housing plate 11 or the inner wall of the second housing plate 12 by means of sintering or welding. The first capillary structure 21 can include one or more of wire mesh, powder sintered material, metal felt, fiber bundle, foam metal and laminated perforated metal sheets. Preferably, a concave structure can be provided at one end of the first capillary structure 21 closing to the compensation chamber 6 to form the second vapor chamber 23 between the concave structure and the housing 1.

Figure 5:
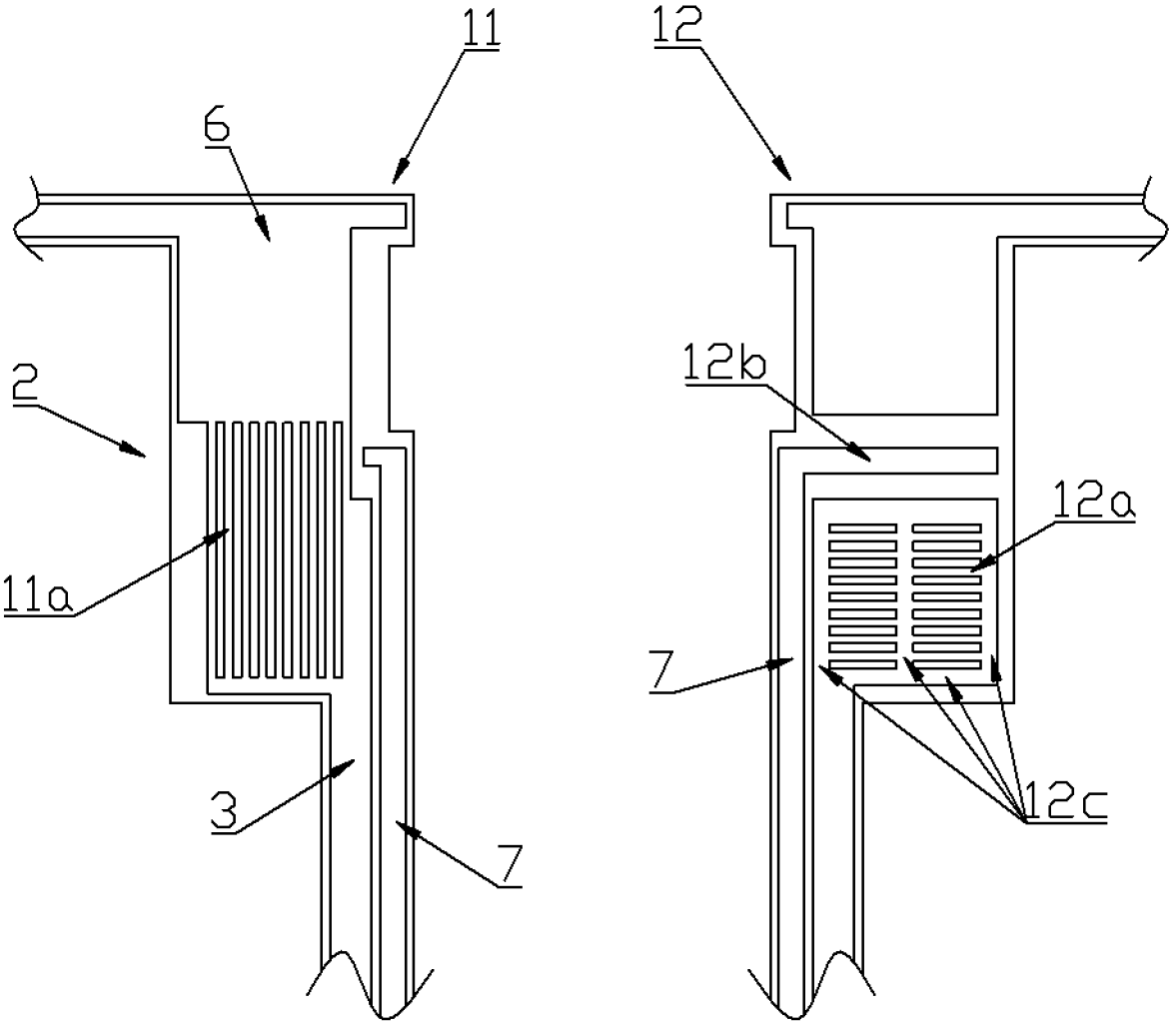
FIG. 5 is a schematic view of a first capillary structure having a separable structure of the thin-plate loop heat pipe according to the third embodiment of the present disclosure.

Refer to FIG. 5, in another embodiment, the first capillary structure 21 and the housing 1 can form a one-piece structure. Multiple first microchannels 11*a* are etched on the inner wall of the first housing plate 11 at the evaporation chamber 2. Multiple second microchannels 12*a* are etched on the inner wall of the second housing plate 12 at the evaporation chamber 2. Both the first microchannels 11*a* and the second microchannels 12*a* can allow the liquid-phase working medium to permeate and can block vaporized working medium due to their extremely small width. The first microchannels 11*a* and the second microchannels 12*a* are arranged in a cross pattern, and by this way, a structure with a very small pore size and capillary force is formed, i.e., the first capillary structure 21 is formed. At the same time, the first capillary structure 21, the first housing plate 11 and the second housing plate 12 form the first vapor chamber 22. Preferably, slots 12*c* are formed on the inner wall of the second housing plate 12 at the evaporation chamber 2, and the slots 12*c* communicate with the second microchannels 12*a*. The first vapor chamber 22 is formed between the slots 12*c* and the first microchannel 11*a*, and the vaporized working medium can escape along the slots 12*c* and gather into the vapor channel 3. Preferably, a groove 12*b* is also etched on the inner wall of the second housing plate 12 at the evaporation chamber 2. The groove 12*b* is separated and independent from the second microchannels 12*a*, as well as from the slots 12*c*. One end of the first microchannels 11*a* intersects with the second microchannels 12*a*, and the other end of the first microchannels 11*a* extends to intersect with the groove 12*b*. By this way, the groove 12*b*, the second housing plate 12, the first microchannels 11*a*, and the first housing plate 11 together form the second vapor chamber 23. As the groove 12*b* and the second microchannels 12*a* are separated and independent from each other, the groove 12*b* and the slots 12*c* are also separated and independent from each other. The first microchannels 11*a* intersected and communicated with the groove 12*b* form part of the first capillary structure 21. The first microchannels 11*a* themselves have the properties of allowing the permeation of the liquid-phase working medium and blocking the vaporized working medium. Therefore, the second vapor chamber 23 and the first vapor chamber 22 are separated by the first capillary structure 21. Thus, the first capillary structure 21 is part of the housing 1. Preferably, the width of the first microchannels 11*a* and the width of the second microchannels 12*a* are both less than 0.3 mm. Preferably, the second microchannels 12*a* are arranged at intervals from each other, which is conducive to the escape of the working medium after vaporization.

Preferably, in the present embodiment, referring to FIG. 1, a second capillary structure 42 can be provided in the condensation chamber 4. The second capillary structure 42 can extend to the evaporation chamber 2, after passing through one or more of the vapor channel 3, the liquid channel 5 and the auxiliary fluid channel 7, and contact or connect with the first capillary structure 21. FIG. 1 only shows the case where the second capillary structure 42 extends to the evaporation chamber 2 through the vapor channel 3 and contacts or connects with the first capillary structure 21. The second capillary structure 42 can guide the liquid-phase working medium in the condensation chamber 4 to the first capillary structure 21 in the evaporation chamber 2, so that the liquid-phase working medium soaks the first capillary structure 21, thereby preventing the thin-plate loop heat pipe 100 of this embodiment from being in a dry state before the thin-plate loop heat pipe 100 is started, so as to ensure that the thin-plate loop heat pipe 100 can be started normally.

In the present embodiment, the shape and structure forms of the second capillary structure 42 are not limited.

In one embodiment, the second capillary structure 42 and the housing 1 can form a one-piece structure, and the second capillary structure 42 is a third microchannel etched on the inner wall of the first housing plate 11 and/or the second housing plate 12. Specifically, the second capillary structure 42 can be formed by etching the third microchannel on the inner wall of either the first housing plate 11 or the second housing plate 12, or on the inner walls of both the first housing plate 11 and the second housing plate 12. Preferably, the width of the third microchannel is less than 0.3 mm. Thus, the second capillary structure 42 is part of the housing 1.

In another embodiment, the second capillary structure 42 and the housing 1 can be separate structures, the second capillary structure 42 can be combined with the inner wall of the first housing plate 11 or the inner wall of the second housing plate 12 by means of sintering or welding. The second capillary structure 42 can include one or more of wire mesh, powder sintered material, metal felt, fiber bundle, foam metal and laminated perforated metal sheets.

Figure 6:
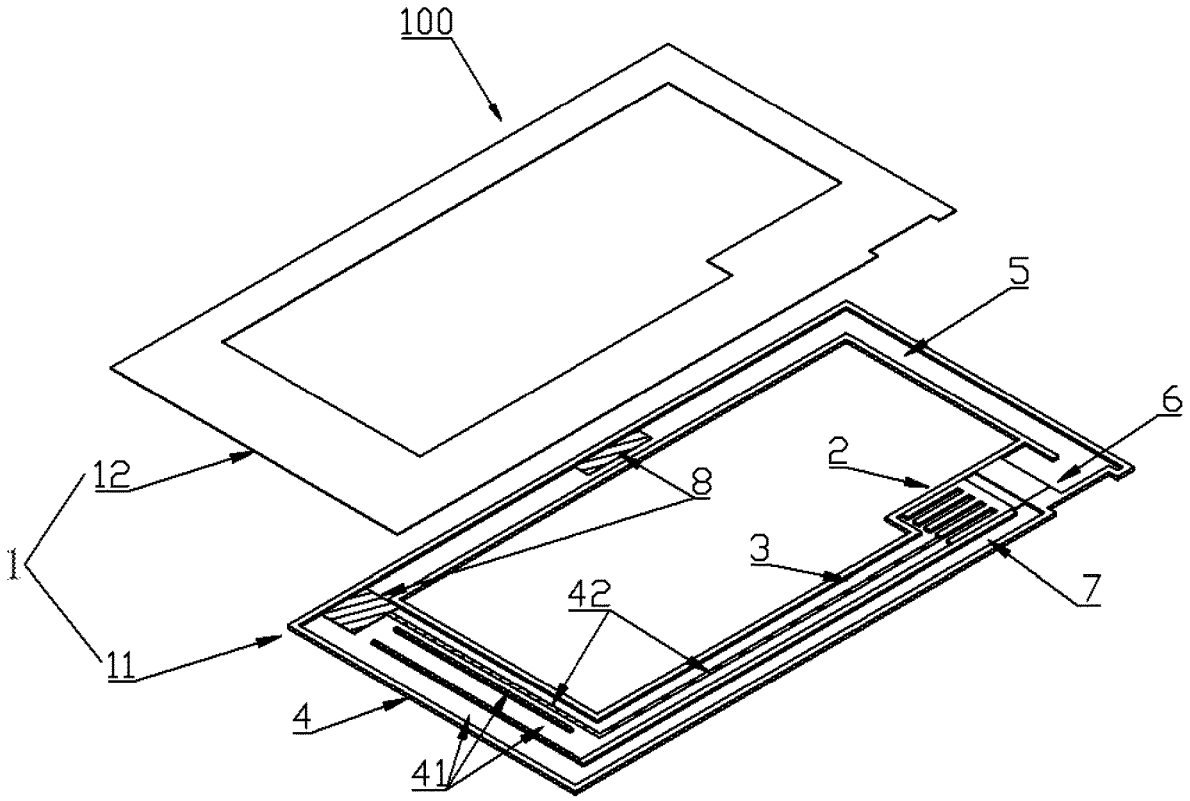
FIG. 6 is a schematic view of a thin-plate loop heat pipe according to the fourth embodiment of the present disclosure.

Preferably, in the present embodiment, referring to FIG. 6, a third capillary structure 8 is provided in one or more of the condensation chamber 4, the vapor channel 3, the liquid channel 5 and the auxiliary fluid channel 7. FIG. 6 only shows the case where the third capillary structure 8 is provided in the condensation chamber 4 and the liquid channel Refer to FIG. 7, compact electronic devices 200, such as smartphones, tablets, laptops, and wearable electronic devices, typically have multiple heat sources 202, 203, 204 with scattered locations. When the thin-plate loop heat pipe 100 of this embodiment is adopted, the evaporation chamber 2 may contact with the heat source 202 which has the largest heat generation in the electronic device 200, and the third capillary structure 8 provided in the condensation chamber 4, the vapor channel 3, the liquid channel 5 and the auxiliary fluid channel 7 may contact with other heat sources 203, 204 which have relatively small heat generation in the electronic device 200 according to installation positions. The evaporation chamber 2 absorbs the heat from the heat source 202, the liquid-phase working medium in the first vapor chamber 22 and the second vapor chamber 23 is heated and vaporized, and the vaporized working medium flows along the vapor channel 3 and the auxiliary fluid channel 7, respectively. During the flow process of the vaporized working medium, the vaporized working medium will release heat to the outside via the housing 1 and the shell 201 of the electronic device 200 that is in thermal contact with the vaporized working medium, such that part of the vaporized working medium is condensed into the liquid-phase working medium. This part of the liquid-phase working medium flows along the vapor channel 3 and the auxiliary fluid channel 7, during this flow process, the liquid-phase working medium is absorbed by the third capillary structure 8 provided in the vapor channel 3 and the auxiliary fluid channel 7, and the liquid-phase working medium can be vaporized again by absorbing the heat from the corresponding heat source here. The vaporized working medium continues to flow forward along the circulation loop. Repeating the above-mentioned process from releasing heat to the outside and condensation to vaporization upon encountering a heat source, until the vaporized working medium enters the condensation chamber 4. The condensed liquid-phase working medium in the condensation chamber 4 flows along the condensation chamber 4 and the liquid channel during this flow process, the liquid-phase working medium is absorbed by the third capillary structure 8 provided in the condensation chamber 4 and the liquid channel 5, and the liquid-phase working medium can be vaporized by absorbing the heat from the corresponding heat source here, such that part of the liquid-phase working medium is vaporized into the vaporized working medium. This part of the vaporized working medium flows along the liquid channel 5, during this flow process, the vaporized working medium will release heat to the outside via the housing 1 and the shell 201 of the electronic device 200 that is in thermal contact with the vaporized working medium, and will be condensed again. The liquid-phase working medium continues to flow forward along the circulation loop. Repeating the above-mentioned process from vaporization upon encountering a heat source to releasing heat to the outside and condensation, until the liquid-phase working medium enters the compensation chamber 6. As a result, the thin-plate loop heat pipe 100 of this embodiment can realize simultaneous heat dissipation for multiple heat sources of the electronic device 200 along its circulation loop, and has a very strong heat dissipation capability.

Figure 7:
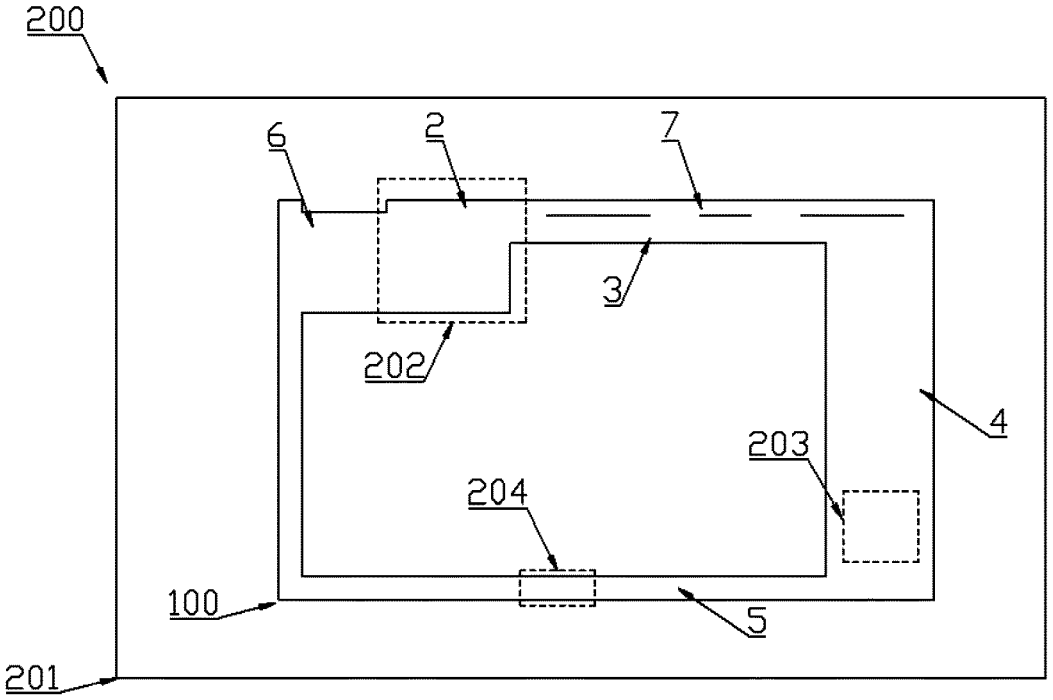
FIG. 7 is a schematic view of the usage of the thin-plate loop heat pipe according to the fourth embodiment of the present disclosure.

It should be noted that, during the working process, the positions of the heat source and the heat dissipation of a compact electronic device 200 are not limited to the positions of the heat sources 202, 203, 204 shown in FIG. 7. In fact, as the structure of the electronic device 200 and the thin-plate loop heat pipe 100 is compact and miniaturized, the positions of the heat source and the heat dissipation of the electronic device 200 may exist at any location on the entire circulation loop of the thin-plate loop heat pipe 100, the heat dissipation position of the electronic device 200 may also cover the entire thin-plate loop heat pipe 100.

Therefore, it should be noted that, when the thin-plate loop heat pipe 100 of this embodiment is adopted, the vaporized working medium in the first vapor chamber 22 and the second vapor chamber 23 enters the vapor channel 3 and the auxiliary fluid channel 7, respectively. During the flow process along the vapor channel 3 and the auxiliary fluid channel 7, the vaporized working medium will release heat to the outside via the housing 1 and the shell 201 of the electronic device 200 that is in thermal contact with the vaporized working medium, such that part of the vaporized working medium is condensed into liquid-phase working medium. This part of the liquid-phase working medium flows along the vapor channel 3 and the auxiliary fluid channel 7, during this flow process, when the liquid-phase working medium passes through the heat dissipation part of the electronic device 200, the liquid-phase working medium will absorb heat and vaporize again, and continue to flow forward along the circulation loop. Repeat the above-mentioned process from releasing heat to the outside and condensation to absorbing heat and vaporization, until the vaporized working medium enters the condensation chamber 4. When the liquid-phase working medium does not pass through the heat dissipation part of the electronic device 200, the liquid-phase working medium will flow directly into the condensation chamber 4. Therefore, the vapor channel 3 and the auxiliary fluid channel 7 actually also have condensation functions. The condensed liquid-phase working medium in the condensation chamber 4 enters the liquid channel 5, during this flow process, when the liquid-phase working medium passes through the heat dissipation part of electronic devices 200, the liquid-phase working medium will absorb heat and vaporize, such that part of the liquid-phase working medium is vaporized into the vaporized working medium. This part of the vaporized working medium flows along the liquid channel 5, during this flow process, the vaporized working medium will release heat to the outside via the housing 1 and the shell 201 of the electronic device 200 that is in thermal contact with the vaporized working medium, and will be condensed again. The liquid-phase working medium continues to flow forward along the circulation loop. Repeat the above-mentioned process from absorbing heat and vaporization to releasing heat to the outside and condensation, until the liquid-phase working medium enters the compensation chamber 6. When the liquid-phase working medium does not pass through the heat dissipation part of the electronic device 200, the liquid-phase working medium will flow directly into the compensation chamber 6. Therefore, the liquid channel 5 actually also has a condensation function. Thus, in the circulation loop of the thin-plate loop heat pipe 100 of this embodiment, the vapor channel 3, the auxiliary fluid channel 7, the condensation chamber 4 and the liquid channel 5 can be regarded as a condensation area as a whole. The working medium flows along the circulation loop except the evaporation chamber 2, presenting multiple repeated cycles from condensation to vaporization and to condensation again, and finally flows into the compensation chamber 6 in the form of the liquid-phase working medium.

In the present embodiment, the shape and structure forms of the third capillary structure 8 are not limited.

In an embodiment, the third capillary structure 8 and the housing 1 can form a one-piece structure, and the third capillary structure 8 is a fourth microchannel etched on the inner wall of the first housing plate 11 and/or the second housing plate 12. Specifically, the third capillary structure 8 can be formed by etching the fourth microchannel on the inner wall of either the first housing plate 11 or the second housing plate 12, or on the inner walls of both the first housing plate 11 and the second housing plate 12. Preferably, the width of the fourth microchannel is less than 0.3 mm. Thus, the third capillary structure 8 is part of the housing 1.

In another embodiment, the third capillary structure 8 and the housing 1 can be separate structures, the third capillary structure 8 can be combined with the inner wall of the first housing plate 11 or the inner wall of the second housing plate 12 by means of sintering or welding. The third capillary structure 8 can include one or more of wire mesh, powder sintered material, metal felt, fiber bundle, foam metal and laminated perforated metal sheets.

Figure 8:
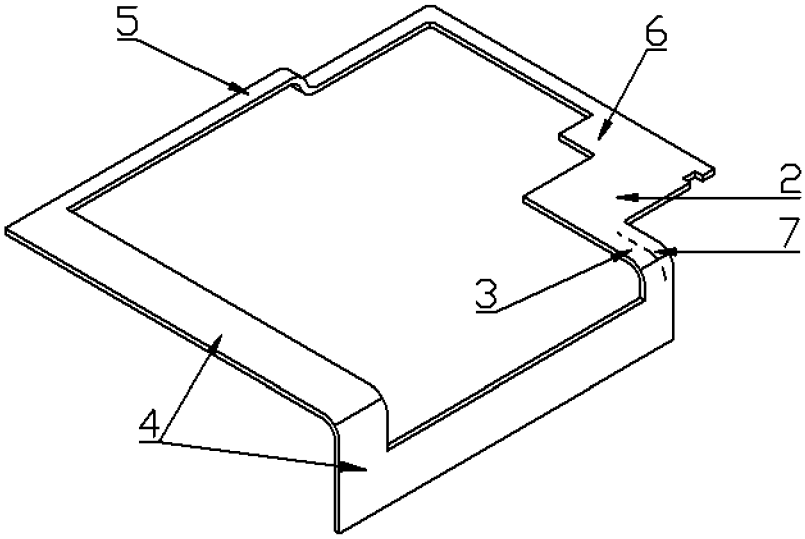
FIG. 8 is a schematic view of a thin-plate loop heat pipe according to the fifth embodiment of the present disclosure.

Refer to FIGS. 1, 4, 6 and 9, the housing 1 of the thin-plate loop heat pipe 100 of this embodiment may have a flat shape. Refer to FIG. 8, the housing 1 of the thin-plate loop heat pipe 100 of this embodiment can also be bent in a curved shape at any one or more positions except the evaporation chamber 2. FIG. 8 only shows the situation that the condensation chamber 4 and the liquid channel 5 are respectively bent in a curved shape. Therefore, the thin-plate loop heat pipe 100 of this embodiment can match the compact spatial layout of the electronic device 200, and realize the flexible arrangement of the thin-plate loop heat pipe 100 of this embodiment within the shell 201 of the electronic device 200 based on the compact spatial layout of the electronic device 200.

The material of the housing 1 of the thin-plate loop heat pipe 100 according to the present embodiment is not limited. For example, both the first housing plate 11 and the second housing plate 12 can be made of metal sheets, such as copper sheets with excellent thermal conductivity, and the two can be combined by means of diffusion welding. The housing 1 can also be made of non-metallic material.

Preferably, in the present embodiment, both the first housing plate 11 and the second housing plate 12 are thin plates, and the thickness of the thin plates can be 0.2 mm-0.3 mm. The thicknesses of the first housing plate 11 and the second housing plate 12 can be the same or different.

The working medium in the thin-plate loop heat pipe 100 of this embodiment can be properly selected based on the requirements of the working temperature when used.

Six specific embodiments of the thin-plate loop heat pipe 100 of this embodiment are provided below.

FIGS. 1 to 3 show a first embodiment of the thin-plate loop heat pipe 100 according to the present disclosure. In the first embodiment, a first housing plate 11 and a second housing plate 12 are relatively covered and sealed together at edges to form a housing 1 having a loop shape, and the housing 1 has a flat shape. A recessed area is etched on the inner wall of the first housing plate 11 and/or the second housing plate 12. An evaporation chamber 2, a vapor channel 3, a condensation chamber 4, a liquid channel 5, a compensation chamber 6, and an auxiliary fluid channel 7 are formed at the recessed area between the first housing plate 11 and the second housing plate 12. The evaporation chamber 2, the vapor channel 3, the condensation chamber 4, the liquid channel 5 and the compensation chamber 6 are arranged in sequence along the circumference of the housing 1 and communicated with each other to form a closed loop. A first capillary structure 21 is provided in the evaporation chamber 2 to divide the evaporation chamber 2 into a first vapor chamber 22 and a second vapor chamber 23. The first capillary structure 21 and the housing 1 are separate structures. A concave structure is formed on one end of the first capillary structure 21 closing to the compensation chamber 6 to form the second vapor chamber 23 between the concave structure and the housing 1. The second vapor chamber 23 is separated from the compensation chamber 6 by the first capillary structure 21, and by the first capillary structure 21, the second vapor chamber 23 is also separated from the first vapor chamber 22. The first vapor chamber 22 and the condensation chamber 4 communicate with each other by the vapor channel 3, the second vapor chamber 23 and the condensation chamber 4 communicate with each other by the auxiliary fluid channel 7, and the auxiliary fluid channel 7 is located at one side of the vapor channel 3 and share sealing edges of the housing 1 with the vapor channel 3. Multiple flow channels 41 are provided in the condensation chamber 4. A second capillary structure 42 is provided in the condensation chamber 4. The second capillary structure 42 extends to the evaporation chamber 2, after passing through one or more of the vapor channel 3, the liquid channel 5 and the auxiliary fluid channel 7, and contacts or connects with the first capillary structure 21. And FIGS. 1 to 3 only show the situation that the second capillary structure 42 extends to the evaporation chamber 2 through the vapor channel 3 and contacts or connects with the first capillary structure 21. The second capillary structure 42 and the housing 1 form a one-piece structure or are separate structures. The thin-plate loop heat pipe 100 is accommodated in a shell 201 of an electronic device 200 when in use, and is in contact with a heat source 202 of the electronic device 200 by the evaporation chamber 2.

Figure 4:
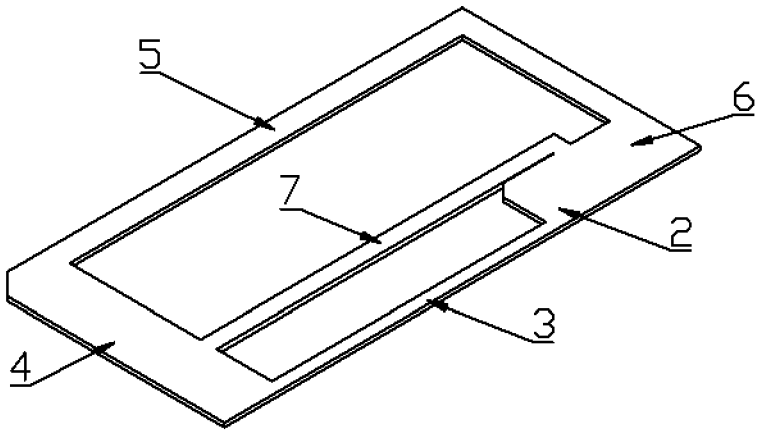
FIG. 4 is a schematic view of a thin-plate loop heat pipe according to the second embodiment of the present disclosure.

FIG. 4 shows a second embodiment of the thin-plate loop heat pipe 100 according to the present disclosure. The second embodiment is basically the same as the first embodiment, and the similarities will not be repeated. The differences are that in the second embodiment, the auxiliary fluid channel 7 has sealing edges that are independent from the vapor channel 3 and the liquid channel 5, and interval spaces are formed between the auxiliary fluid channel 7 and the vapor channel 3 as well as between the auxiliary fluid channel 7 and the liquid channel 5.

FIG. 5 shows a third embodiment of the thin-plate loop heat pipe 100 according to the present disclosure. The third embodiment is basically the same as the first embodiment, and the similarities will not be repeated. The differences are that in the third embodiment, the first capillary structure 21 and the housing 1 form a one-piece structure, multiple first microchannels 11*a* are etched on the inner wall of the first housing plate 11 at the evaporation chamber 2. Multiple second microchannels 12*a* are etched on the inner wall of the second housing plate 12 at the evaporation chamber 2. The first microchannel 11*a* and the second microchannel 12*a* are arranged in a cross pattern to form the first capillary structure 21. At the same time, the first capillary structure 21, the first housing plate 11, and the second housing plate 12 form the first vapor chamber 22. A groove 12*b* is also etched on the inner wall of the second housing plate 12 at the first capillary structure 21 to form the second vapor chamber 23 between the groove 12*b* and the housing 1.

FIGS. 6 and 7 show a fourth embodiment of the thin-plate loop heat pipe 100 according to the present disclosure. The fourth embodiment is basically the same as the above-mentioned first embodiment, and the similarities will not be repeated. The differences are that in the fourth embodiment, a third capillary structure 8 is provided in one or more of the condensation chamber 4, the vapor channel 3, the liquid channel 5 and the auxiliary fluid channel 7. And FIGS. 6 and 7 only show the situation that the third capillary structure 8 is provided in the condensation chamber 4 and the liquid channel 5. When the thin-plate loop heat pipe 100 is used, the evaporation chamber 2 contacts with the heat source 202 which has the largest heat generation in the electronic device 200, and the third capillary structure 8 provided in the condensation chamber 4, the vapor channel 3, the liquid channel 5 and the auxiliary fluid channel 7 contact with other heat sources 203, 204 which have relatively small heat generation in the electronic device 200 according to installation positions. The third capillary structure 8 and the housing 1 form a one-piece structure or are separate structures.

FIG. 8 shows a fifth embodiment of the thin-plate loop heat pipe 100 according to the present disclosure. The fifth embodiment is basically the same as the above-mentioned first embodiment, and the similarities will not be repeated. The differences are that in the fifth embodiment, the housing 1 can be bent in a curved shape at any one or more positions except the evaporation chamber 2. FIG. 8 only shows the situation that the condensation chamber 4 and the liquid channel 5 are respectively bent in a curved shape.

FIG. 9 shows a sixth embodiment of the thin-plate loop heat pipe 100 according to the present disclosure. The sixth embodiment is basically the same as the above-mentioned first embodiment, and the similarities will not be repeated. The differences are that in the sixth embodiment, the auxiliary fluid channel 7 has sealing edges that are independent from the vapor channel 3 and the liquid channel 5, and interval spaces are formed between the auxiliary fluid channel 7 and the vapor channel 3, as well as between the auxiliary fluid channel 7 and the liquid channel 5. And, the auxiliary fluid channel 7 is directly connected with the liquid channel 5.

The above description is only preferred embodiments of the present disclosure, and it should be noted that for those of ordinary skill in the art, various improvements and replacements can be made without departing from the technical principle of the present disclosure, these improvements and replacements should also be considered as the protection scope of the present disclosure.

What is claimed is:

1. A thin-plate loop heat pipe, comprising a housing (1), wherein the housing (1) comprises a first housing plate (11) and a second housing plate (12) that are relatively covered and sealed together at edges, wherein an evaporation chamber (2), a vapor channel (3), a condensation chamber (4), a liquid channel (5), a compensation chamber (6) and an auxiliary fluid channel (7) are formed between the first housing plate (11) and the second housing plate (12), wherein a first capillary structure (21) is provided in the evaporation chamber (2) to form a first vapor chamber (22) and a second vapor chamber (23) located between the first vapor chamber (22) and the compensation chamber (6), wherein the first vapor chamber (22) and the condensation chamber (4) communicate with each other by the vapor channel (3), the condensation chamber (4) and the compensation chamber (6) communicate with each other by the liquid channel (5), and the second vapor chamber (23) and the condensation chamber (4) communicate with each other by the auxiliary fluid channel (7), wherein the first vapor chamber (22) is configured to evaporate a first liquid-phase working medium in the first vapor chamber (22) into a first vaporized working medium when heated by a heat source (202), and to pass the first vaporized working medium through the vapor channel (3) to the condensation chamber (4), wherein the second vapor chamber (23) is configured to evaporate a second liquid-phase working medium in the second vapor chamber (23) into a second vaporized working medium when receiving heat leaked from the first vapor chamber (22), and to pass the second vaporized working medium through the auxiliary fluid channel (7) to the condensation chamber (4), thereby reducing a heat transfer temperature difference of the thin-plate loop heat pipe, and wherein the condensation chamber (4) is configured to condense the first vaporized working medium into a first condensed working medium and the second vaporized working medium into a second condensed working medium within the same condensation chamber (4), and to pass the first condensed working medium and the second condensed working medium to the compensation chamber (6) through the liquid channel (5).

2. The thin-plate loop heat pipe according to claim 1, wherein a flow channel (41) is provided in the condensation chamber (4).

3. The thin-plate loop heat pipe according to claim 1, wherein two ends of the auxiliary fluid channel (7) are respectively connected with the second vapor chamber (23) and the liquid channel (5).

4. The thin-plate loop heat pipe according to claim 1, wherein a recessed area is etched on an inner wall of the first housing plate (11) and/or the second housing plate (12), wherein the evaporation chamber (2), the vapor channel (3), the condensation chamber (4), the liquid channel (5), the compensation chamber (6) and the auxiliary fluid channel (7) are formed at the recessed area between the first housing plate (11) and the second housing plate (12).

5. The thin-plate loop heat pipe according to claim 1, wherein the housing (1) has a loop shape, wherein the evaporation chamber (2), the vapor channel (3), the condensation chamber (4), the liquid channel (5) and the compensation chamber (6) are arranged in sequence along a circumference of the housing (1) to form a closed loop.

6. The thin-plate loop heat pipe according to claim 5, wherein the auxiliary fluid channel (7) is located at one side of the vapor channel (3) and shares sealing edges of the housing (1) with the vapor channel (3), or the auxiliary fluid channel (7) is located at one side of the liquid channel (5) and shares sealing edges of the housing (1) with the liquid channel (5).

7. The thin-plate loop heat pipe according to claim 5, wherein the auxiliary fluid channel (7) has sealing edges that are independent from the vapor channel (3) and the liquid channel (5).

8. The thin-plate loop heat pipe according to claim 1, wherein the first capillary structure (21) and the housing (1) are separate structures, wherein the first capillary structure (21) comprises one or more of wire mesh, powder sintered material, metal felt, fiber bundle, foam metal and laminated perforated metal sheets.

9. The thin-plate loop heat pipe according to claim 8, wherein a recess is formed on a top surface of the first capillary structure (21), inset from one end of the first capillary structure (21) close to compensation chamber (6), and the second vapor chamber (23) is defined between a boundary of the recess and the housing (1).

10. The thin-plate loop heat pipe according to claim 1, wherein the first capillary structure (21) and the housing (1) form a one-piece structure, wherein a plurality of first microchannels (11*a*) are etched on an inner wall of the first housing plate (11) at the evaporation chamber (2), a plurality of second microchannels (12*a*) are etched on an inner wall of the second housing plate (12) at the evaporation chamber (2), and the first microchannel (11*a*) and the second microchannel (12*a*) are arranged in a cross pattern to form the first capillary structure (21).

11. The thin-plate loop heat pipe according to claim 10, wherein a groove (12*b*) is also etched on the inner wall of the second housing plate (12) at the evaporation chamber (2), wherein the groove (12*b*) and the second microchannel (12*a*) are separated and independent from each other, wherein one end of the first microchannel (11*a*) intersects with the second microchannel (12*a*), and the other end of the first microchannel (11*a*) extends to intersect with the groove (12*b*), wherein the groove (12*b*), the second housing plate (12), the first microchannel (11*a*) and the first housing plate (11) together form the second vapor chamber (23).

12. The thin-plate loop heat pipe according to claim 1, wherein a second capillary structure (42) is provided in the condensation chamber (4), wherein the second capillary structure (42) extends to the evaporation chamber (2) after passing through one or more of the vapor channel (3), the liquid channel (5) and the auxiliary fluid channel (7), and contacts or connects with the first capillary structure (21).

13. The thin-plate loop heat pipe according to claim 12, wherein the second capillary structure (42) is a third microchannel etched on an inner wall of the first housing plate (11) and/or the second housing plate (12), or the second capillary structure (42) includes one or more of wire mesh, powder sintered material, metal felt, fiber bundle, foam metal and laminated perforated metal sheets.

14. The thin-plate loop heat pipe according to claim 12, wherein the second capillary structure (42) includes one or more of wire mesh, powder sintered material, metal felt, fiber bundle, foam metal and laminated perforated metal sheets.

15. The thin-plate loop heat pipe according to claim 1, wherein a third capillary structure (8) is provided in one or more of the condensation chamber (4), the vapor channel (3), the liquid channel (5) and the auxiliary fluid channel (7).

16. The thin-plate loop heat pipe according to claim 15, wherein the third capillary structure (8) is a fourth microchannel etched on an inner wall of the first housing plate (11) and/or the second housing plate (12), or the third capillary structure (8) includes one or more of wire mesh, powder sintered material, metal felt, fiber bundle, foam metal and laminated perforated metal sheets.

17. The thin-plate loop heat pipe according to claim 15, wherein the third capillary structure (8) includes one or more of wire mesh, powder sintered material, metal felt, fiber bundle, foam metal and laminated perforated metal sheets.

18. The thin-plate loop heat pipe according to claim 1, wherein the housing (1) is bent in a curved shape at any one or more positions except the evaporation chamber (2).

19. The thin-plate loop heat pipe according to claim 1, wherein the first capillary structure (21) is configured to allow the liquid-phase working medium to permeate and to prevent vaporized working medium from circulating between the second vapor chamber (23) and the compensation chamber (6), and between the second vapor chamber (23) and the first vapor chamber (22).

* * * * *